US006530427B1

(12) United States Patent
Jackson

(10) Patent No.: US 6,530,427 B1
(45) Date of Patent: Mar. 11, 2003

(54) CONTROL INSTALLATION FOR SOLID CLEANING MEMBERS CIRCULATING IN A HEAT EXCHANGER

(75) Inventor: Philip Jackson, Paris (FR)

(73) Assignee: E. Beaudrey et Cie, Paris (FR)

( * ) Notice: Subject to any disclaimer, the term of this patent is extended or adjusted under 35 U.S.C. 154(b) by 0 days.

(21) Appl. No.: 09/705,893

(22) Filed: Nov. 6, 2000

(30) Foreign Application Priority Data

Nov. 4, 1999 (FR) ..... 9913813

(51) Int. Cl.[7] ..... F28G 1/12

(52) U.S. Cl. ..... 165/303; 165/95; 165/108; 165/119; 122/380; 134/23

(58) Field of Search ..... 165/303, 11.1, 165/95, 108, 119; 122/380; 134/23, 32

(56) References Cited

U.S. PATENT DOCUMENTS

| | | | | | |
|---|---|---|---|---|---|
| 3,291,197 | A | * | 12/1966 | Kollerup | 165/95 |
| 3,919,732 | A | * | 11/1975 | Honma et al. | 165/95 X |
| 4,234,993 | A | * | 11/1980 | Kintner | 165/95 X |
| 4,314,604 | A | * | 2/1982 | Koller | 165/95 |
| 4,390,058 | A | * | 6/1983 | Otake et al. | 165/95 X |
| 4,413,673 | A | * | 11/1983 | de Maigret | 165/95 |
| 4,420,038 | A | * | 12/1983 | Okouchi et al. | 165/95 |
| 4,435,285 | A | * | 3/1984 | Okouchi et al. | 165/95 X |
| 4,688,630 | A | * | 8/1987 | Borchert | 165/95 |
| 4,694,892 | A | * | 9/1987 | Borchert | 165/95 |
| 4,984,629 | A | * | 1/1991 | Voith et al. | 165/95 |
| 5,010,950 | A | * | 4/1991 | Voith | 165/95 |
| 5,176,204 | A | * | 1/1993 | Ben-Dosa | 165/95 |
| 5,388,636 | A | * | 2/1995 | Peery | 165/95 |
| 5,598,889 | A | * | 2/1997 | Jackson | 165/95 |
| 5,680,665 | A | * | 10/1997 | Anson et al. | 165/95 X |

FOREIGN PATENT DOCUMENTS

| | | | | | |
|---|---|---|---|---|---|
| DE | 1247 359 | | | 8/1967 | |
| DE | 31 25 493 | | | 4/1982 | |
| DE | 40 29 475 | A1 | * | 5/1992 | 165/95 |
| FR | 2 766 915 | | | 2/1999 | |
| GB | 2 274 322 | | | 7/1994 | |
| JP | 57-14198 | A | * | 1/1982 | 165/95 |
| JP | 57-19598 | A | * | 2/1982 | 165/95 |
| JP | 58-184500 | A | * | 10/1983 | 165/95 |
| JP | 59-215599 | A | * | 12/1984 | 165/95 |

* cited by examiner

*Primary Examiner*—Ljiljana Ciric
(74) *Attorney, Agent, or Firm*—Young & Thompson

(57) ABSTRACT

A control installation for solid cleaning members circulating in a heat exchanger includes interception arrangements interposed on the heat exchanger outlet pipe, a return pipe which recycles toward the inlet pipe a return flow containing the solid cleaning members, and a control device for the solid cleaning members. Between the interception arrangements and the control device there is a concentration device dividing the return flow into two parts. The return pipe is part of circulation arrangements which generate a counter-current flow through the interception arrangements and which include suction arrangements in line with the interception device to take up the solid cleaning members retained thereby.

12 Claims, 1 Drawing Sheet

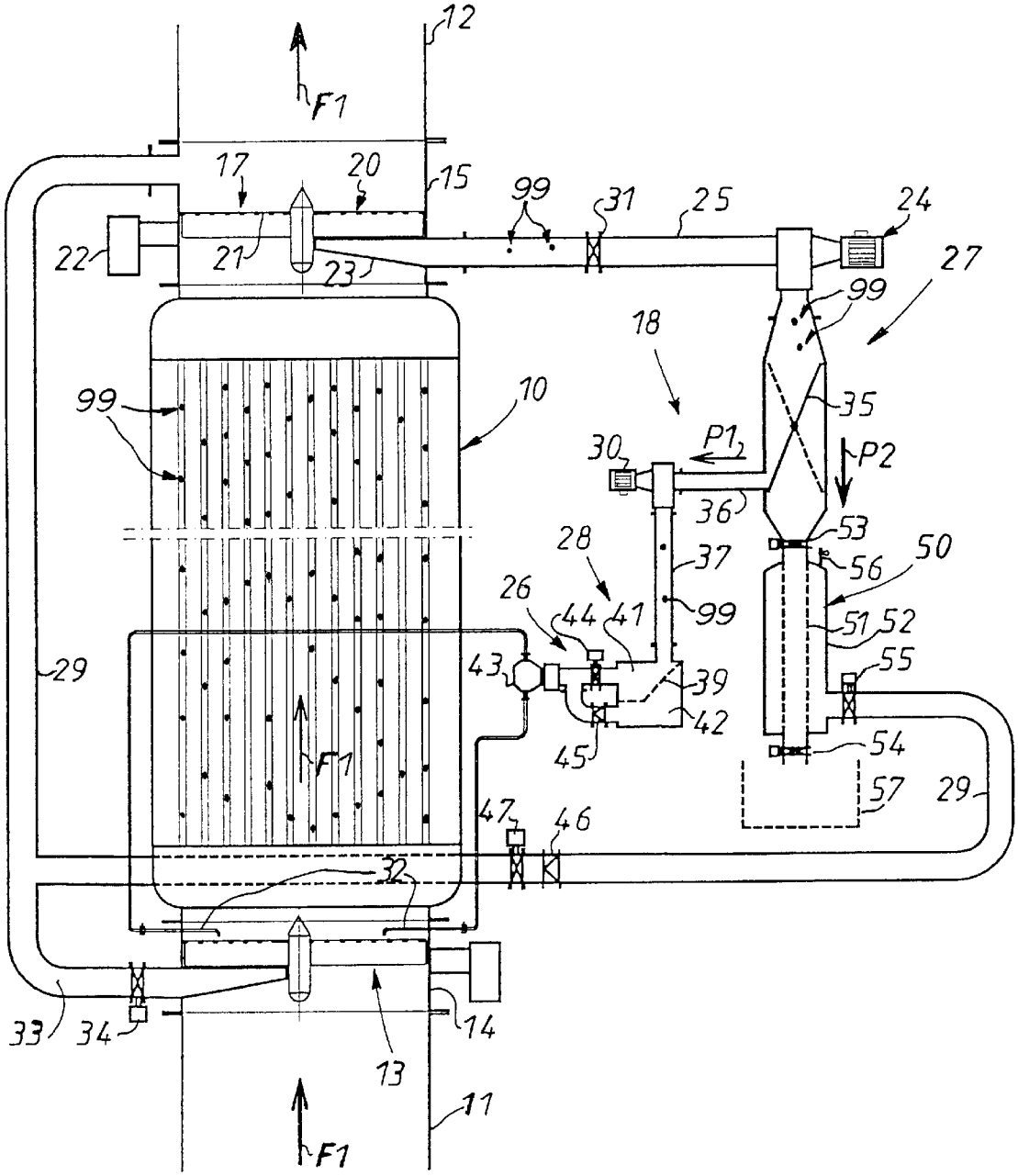
12
F1
17
20
15
99
31
25
24
22
21
23
27
99
18
10
35
99
30
P1
P2
36
53
28
37
50
56
26
44
41
99
51
52
29
43
39
55
42
45
54
F1
57
29
47
46
32
33
34
14
13
11
F1

CONTROL INSTALLATION FOR SOLID CLEANING MEMBERS CIRCULATING IN A HEAT EXCHANGER

BACKGROUND OF THE INVENTION

1. Field of the Invention

The present invention relates generally to heat exchangers and, for example, to tubular heat exchangers forming condensers which are cleaned continuously by solid members systematically circulated for this purpose in one of the flows. The solid members may in practice be foam rubber balls.

2. Description of the Prior Art

The principle of the corresponding arrangements has long been known in the art, in particular from the documents U.S. Pat. No. 1,795,348 and DE-A-23 14 329.

The present invention is more particularly concerned with management of the solid cleaning members used in this way.

If arrangements of the kind described in the document FR-A-2 716 530 are used, for example, controlling the solid cleaning members entails, fundamentally, on the one hand, in order to prevent the solid cleaning members in question being evacuated to a drain with the flow that conveys them, the interposition, on the exit pipe of the heat exchanger, of interception element adapted to retain them, and, on the other hand, recycling, to the inlet pipe of the heat exchanger, solid cleaning members retained in this way by the interception element.

However, in practice, it is also necessary to pass the solid cleaning member systematically through a control device adapted in particular to control their number, to separate and eliminate those whose dimensions have, through wear, become smaller than required, and consequently to replenish the system with new solid cleaning members.

To operate correctly, the control device must have a flow with a given flowrate passing through it.

There has been proposed a control installation for solid cleaning members circulating in a heat exchanger to clean it, of the kind including interception element which, adapted to retain the circulating solid cleaning members, are interposed on the outlet pipe of the heat exchanger, a return pipe, which recycles toward the inlet pipe of the heat exchanger a return flow containing the solid cleaning members retained by the interception element, and, disposed on that return pipe, a control device for the solid cleaning members, in which installation, between the interception element and the control device, there is interposed, on the return pipe, a concentration device dividing the corresponding return flow into two parts; namely, a first part, or principal part, which normally contains all of the solid cleaning members, and which is directed toward the control device, and a second part, or diverted part, which normally contains no solid cleaning members, and which is separated from the control device, the return pipe forming part of circulation means which are adapted to generate, locally, via the interception element, a counter-current flow.

An installation of the above kind is described in the document FR-A-2 766 915, for example.

In this way, the control device is spared some of the flowrate of the return flow concerned, whilst normally receiving all of the solid cleaning element to be controlled.

To be more precise, for a given installation, the concentration device advantageously and systematically recreates at the inlet of the control device particular flow conditions which correspond to its normal operating conditions.

Accordingly, a standard control device can advantageously be used, regardless of the capacity of the installation to be treated, which is beneficial from the cost point of view.

Generally speaking, recycling solid cleaning members retained by the interception element to the inlet pipe of the heat exchanger is achieved by circulation means which push or drive the solid cleaning members toward said inlet pipe. This driving operation is necessarily effected via the interception element and leads to a costly and relatively complicated installation.

SUMMARY OF THE INVENTION

To avoid this drawback, the present invention provides a control installation for solid cleaning members circulating in a heat exchanger to clean it, of the kind including interception element which, adapted to retain the circulating solid cleaning members, are interposed on the outlet pipe of the heat exchanger, a return pipe, which recycles toward the inlet pipe of the heat exchanger a return flow containing the solid cleaning members retained by the interception element, and, disposed on that return pipe, a control device for the solid cleaning members, in which installation, between the interception element and the control device, there is interposed, on the return pipe, a concentration device dividing the corresponding return flow into two parts; namely, a first part, or principal part, which normally contains all of the solid cleaning members, and which is directed toward the control device, and a second part, or diverted part, which normally contains no solid cleaning members, and which is separated from the control device, the return pipe forming part of circulation means which are adapted to generate, locally, via the interception element, a counter-current flow, characterized in that the circulation means include suction means adapted to take up, to recycle them, in line with the interception element, the solid cleaning members retained thereby, the concentration device being of generally cylindrical shape and including a grid mounted to pivot about an axis in its central part so that it can occupy at least two extreme positions; namely, a position referred to as a "cleaning" position in which it allows free passage of the principal part of the return flow and is interposed in the passage of the diverted part of said flow, and a position referred to as a "non-cleaning" position in which it is interposed in the passage of the principal part and the diverted part of the return flow.

The circulation means advantageously include a flow pipe established between the outlet pipe of the heat exchanger and its inlet pipe and connected to the suction of a pump which discharges into the concentration device.

The control installation preferably includes a recycling pipe which directs the diverted part of the return flow to the outlet pipe of the heat exchanger. The recycling pipe is connected to the flow pipe via the concentration device.

Concentration devices with tilting grids have already been proposed. To be more precise, there is known in the art a concentration device in which two grids disposed in a V-shape are mounted to pivot about an axis in their central part and can occupy at least two positions in a V-shape, the point of the V-shape being at the bottom in one of those positions and at the top in the other one. A concentration device of the above kind has the disadvantage that cleaning members are lost during the operation of recovering said members.

According to the invention, the concentration device is connected to the recycling pipe via a filter. This avoids losing any cleaning member.

The filter advantageously has a tubular wall which passes axially and in a sealed manner through an enclosure. The part of the tubular wall situated inside the enclosure being perforated. The tubular wall of the filter communicates with the concentration device via a valve.

The tubular wall of the filter preferably communicates with the outside via a valve.

The recycling pipe is advantageously connected to the outside wall of the enclosure. The recycling pipe is adapted to be shut off by a valve in line with its connection to the outside wall of the enclosure.

The upper part of the enclosure is preferably provided with a vent which is adapted to be shut off.

BRIEF DESCRIPTION OF THE DRAWING

The single FIGURE shows an exemplary embodiment of the invention.

DETAILED DESCRIPTION OF THE PREFERRED EMBODIMENT

The figure shows diagrammatically a heat exchanger 10, for example a heat exchanger forming a condenser, through which flows, as symbolized by the arrowF1, a cooling fluid (in this example water) from an inlet pipe 11 to an outlet pipe 12.

Because a heat exchanger 10 of the above kind is well known in the art, and is not relevant to the present invention in itself, it is not described here.

In practice, it is a tubular heat exchanger, for example of the type succinctly described in the document FR-A-2 716 530 mentioned hereinabove.

In the embodiment shown, filter means 13 are interposed on the inlet pipe 11, by means of a collar 14.

Because the filter means 13 are not essential and are not relevant to the present invention, they are not described further here. The filter means may be of the type described in the document FR-A-2 609 644, for example.

In a manner that is also known in the art, solid cleaning members 99 can be circulated continuously in the heat exchanger 10 to clean it continuously.

In practice, the solid cleaning members may be foam rubber balls whose diameter is slightly greater than that of the tubes of the heat exchanger 10 and whose density in the impregnated state is similar to that of water.

These solid cleaning members must be managed; that is to say, not only circulated effectively in the heat exchanger 10 but also monitored in terms of their number and dimensions.

In a manner that is known in the art, the solid cleaning members are systematically injected into the inlet pipe 11, downstream of the filter means 13, so that they are entrained by the incoming flow.

In a manner that is also known in the art, interception element 17 are interposed on the outlet pipe 12, by means of a collar 15, to retain the circulating solid cleaning members, and, by means of a control installation 18 described in detail hereinafter, the solid cleaning members retained by the interception element 17 are recycled to the inlet pipe 11.

Because they are not relevant to the present invention in themselves, the interception element 17 are not described in detail here. The interception element are filter means of the type constituting the subject matter of the document FR-A-2 715 530 mentioned hereinabove, for example.

Suffice to say, therefore, that the interception element include, on the one hand, a wheel 20 which closes the collar 15 transversely and has, in the radial direction, a filter panel 21 between its axis and its periphery and which, under the control of control means 22, is mounted to rotate about its axis. A pipe 23 which is disposed in line with the wheel 20, on its upstream side referred to the direction of the fluid flow leaving via the outlet pipe 12, and facing toward the filter panel 21 of the wheel 20.

The control installation 18 includes circulation means which are adapted to generate, locally, via the interception element 17, in line with the pipe 23, a counter-current flow, and which include, themselves, to this end, and , a flow pipe 25. To be more precise, a pipe is connected to the pipe 23, disposed upstream of the interception element 17, and a return pipe 28 recycles to the inlet pipe 11 of the heat exchanger 10 a return flow containing the solid cleaning members retained by the interception element 17. On which pipe 28 is disposed a control device 26 for the solid cleaning members to monitor the number thereof, to eliminate those whose dimensions are no longer sufficient, and to replenish the system with new solid cleaning members.

There is interposed, between the interception element 17 and the control device 26, a concentration device 27 adapted to measure the concentration of solid cleaning members in the corresponding return flow.

In other words, on the flow pipe 25 there is interposed, between the interception element 17 and the control device 26, a concentration device 27 dividing the corresponding return flow into two parts, namely, as symbolized by the arrows P1, P2 in the figure, a principal part P1 which contains all of the circulating solid cleaning members, and which is directed toward the control device 26, and a second diverted part P2 which contains no solid cleaning members, and which is separated from the control device 26 and directed to the outlet pipe 12 of the heat exchanger 10 by a pipe 29 referred to as the recycling pipe.

To be more precise, in this embodiment, this recycling pipe 29 is connected to the outlet collar 15. To be even more precise, the circulation means include a pump 24 whose suction is connected to the flow pipe 25 with the recycling pipe 29 being connected downstream of the pump 24 to the concentration device 27 which is itself connected to the discharge of the pump 24.

In practice, the principal part P1 corresponds to a lesser part of the treated return flow and the diverted part P2 to a greater part thereof.

In other words, the principal part Pi has a relatively low flowrate and the diverted part P2 has a relatively high flowrate.

In the embodiment shown, there is provided, on the flow pipe 25, upstream of the concentration device 27, a valve 31, and there is provided, on the return pipe 28, downstream of the concentration device 27, a pump 30 disposed between two sections of the return pipe 28, namely a first section 36 and a second section 37, the control device 26 being downstream of the second section 37 and the first section 36 originating laterally from the lower part of the concentration device 27.

Preferably, and as shown, the return pipe 28 is connected, in the short pipe section 14, to nozzles 32 which inject, into the incoming flow, solid cleaning members which are to be put into circulation or put back into circulation therein, and which are preferably oriented in a counter-current manner.

The control device 26 is not relevant to the present invention and is not described in detail here. Note simply that the control device 26 includes two compartments separated by a grid 39, namely a first compartment 41 into which the second section 37 discharges and a second compartment 42.

The two compartments 41 and 42 are connected, among other things, to a distributor 43 for feeding the nozzles 32, the first compartment 41 via a valve 44 and the second compartment 42 via a check valve 45.

In the embodiment shown, an exhaust pipe 33, controlled by a valve 34, connects the filter means 13 to the recycling pipe 29, and thus to the outlet pipe 12 of the heat exchanger 10, to evacuate debris retained by the filter means In the embodiment shown, the concentration device 27 is of generally cylindrical shape and includes a grid 35, for example consisting of bars the distance between which is less than the diameter of the solid cleaning members. The grid 35 is mounted to pivot about an axis in its central part so that it can occupy at least two extreme positions. There is a first position referred to as a "cleaning" position shown in full line in the figure and in which the grid allows free communication of the cleaning members between the flow pipe 25 and the control device 26, i.e., the grid allows the passage of cleaning members through the principal part Pi and blocks the passage of the cleaning members through diverted part P2. There is also a second position referred to as a "non-cleaning" position, shown in dashed line in the figure. In the second position the grid is interposed in the passage of the principal part Pi and in that of the diverted part P2, i.e., blocking the cleaning members from the whole of the return flow.

According to another important feature of the invention, the concentration device 27 is connected to the recycling pipe 29 via a filter 50.

To be more precise, the filter 50 includes a tubular wall 51 which passes axially and in a sealed manner through an enclosure 52; the tubular wall 51 communicates, on one side, with the lower part of the concentration device 27, via a valve 53, and, on the other side, with the outside, via a valve 54. The part of the tubular wall 51 inside the enclosure 52 is perforated; the recycling pipe 29 is connected to the outside wall of the enclosure 52, to the lower part thereof, in line with which it is adapted to be shut off by a valve 55. The upper part of the enclosure 52 carries a vent 56 which is adapted to be shut off.

A check valve 46 and a valve 47 are also disposed on the recycling pipe 29.

The operation of the installation that has just been described is as follows.

In all cases, the valves 31 and 47 are open; they are provided only to facilitate certain maintenance operations.

Normally, except when cleaning the tubes of the heat exchanger 10, the grid 35 of the concentration device 27 is in the "cleaning" position shown in continuous line, the valves 53 and 55 are open, the valves 44 and 54 are closed, the vent 56 is closed, the pump 24 is running and the pump 30 is stopped.

Accordingly, the cleaning members are stored upstream of the grid 39 and the valve 44 of the control device 26; the flow drawn by the pump 24 returns to the outlet pipe 12 via the concentration device 27, the filter 50 and the recycling pipe 29.

To clean the tubes of the heat exchanger 10 it suffices to open the valve 44 and run the pump 30.

In service, the solid cleaning members therefore pass continuously through the heat exchanger 10, and, retained by the interception element 17 at the outlet therefrom, are aspirated by the pump 24 and recycled after they have passed successively through the concentration device 27, which separates them from the greater part of the corresponding flow, and pass through the control device 26, which treats them.

To stop the circulation of cleaning members, and to group them together, the valve 44 of the control device 26 is closed and the cleaning members are stopped by its grid 39.

It is possible to effect an operation of this kind more quickly by tilting the grid 35 to the "non-cleaning" position, shown in dashed line, of the concentration device 27.

It is from this position of the grid 35 that it is possible to extract the cleaning members from the installation. To this end, initially, the grid 35 is tilted back toward its cleaning position, which causes the cleaning members to return to the interior of the perforated tubular wall 51; secondly, the pumps 24 and 30 are stopped, and the valves 53 and 55 are closed, which isolates the filter 50 from the installation; by opening the vent 56 and the valve 54, the filter 50 is emptied, for example into a container 57 placed under it.

Thus, the invention provides an installation that is simple, light and economical, and regardless of the nature of the cleaning member management operation, none of the cleaning members can be lost.

Thanks to the concentration device 27, the flow conditions at the inlet of the control device 26 are well defined, and correspond to the normal operating conditions of the control device 26.

I claim:

1. A control installation for circulating solid cleaning members for cleaning a heat exchanger, the heat exchanger having an inlet pipe and an outlet pipe, said control installation comprising:

an interception element adapted to retain the cleaning members, the interception element being interposed on the outlet pipe of the heat exchanger;

a return pipe connecting the interception element and the inlet pipe to recycle a return flow containing the cleaning members retained by the interception element to the inlet pipe;

a control device on the return pipe, the control device for controlling flow of the cleaning members;

a concentration device on the return pipe between the interception element and the control device, the concentration device dividing the return flow into a principal part flow directed toward the control device and a diverted part flow directed away from the control device;

the return pipe forming part of a circulation means adapted to recycle toward the inlet pipe of the heat exchanger a return flow containing the solid cleaning members, the circulation means including a pump adapted to take up and to recycle solid cleaning members, the concentration device being of generally cylindrical shape and including a grid mounted to pivot about an axis in a central part of the concentration device, the grid being positionable in a first extreme position for cleaning the heat exchanger in which the grid allows free passage of the cleaning members through the principal part flow and bars the cleaning members from passing through the diverted part flow, the grid being positionable in a second extreme position in which the grid prevents the cleaning members from passing through the principal part flow and from passing through the diverted part flow, the circulation means including a flow pipe connecting the outlet pipe and the inlet pipe of the heat exchanger, the flow pipe being connected to a suction of the pump, the pump discharging into the concentration device; and a recycling pipe which directs the diverted part flow to the outlet pipe of the heat exchanger, the recycling pipe being connected to the flow pipe via a filter and via the concentration device, wherein the filter has a tubular wall passing axially through an enclosure, that part of the tubular wall situated inside the enclosure being perforated.

2. The control installation claimed in claim 1 wherein the tubular wall of the filter communicates with the concentration device via a valve.

3. The control installation claimed in claim 1 wherein the tubular wall of the filter communicates outside the filter via a valve.

4. The control installation claimed in claim 1 wherein the recycling pipe is connected to an outside wall of the enclosure.

5. The control installation claimed in claim 4 wherein the recycling pipe is adapted to be shut off by a valve in line with the recycling pipe's connection to the outside wall of the enclosure.

6. The control installation claimed in claim 1 wherein the upper part of the enclosure is provided with a vent which is adapted to be shut off.

7. A control system for circulating solid cleaning members for cleaning a heat exchanger, the heat exchanger having an inlet pipe and an outlet pipe, said control system comprising:

an interception element mounted in the outlet pipe of the heat exchanger and blocking the cleaning members from passing through that part of the outlet pipe that is downstream of the interception element;

a flow pipe connected to the outlet pipe for taking the cleaning members blocked by the interception element;

a first pump with a suction connected to an outlet end of the flow pipe;

a concentration device with a inlet connected to a discharge of the first pump;

a return pipe having an inlet end connected to a first outlet of the concentration device, the return pipe having an outlet connecting to the inlet pipe to recycle a return flow containing the cleaning members retained by the interception element to the inlet pipe;

a control device on the return pipe, the control device for controlling a flow of the cleaning members into the inlet pipe, the concentration device dividing the return flow into a principal part flow directed toward the control device via the first outlet and via the return pipe and into a diverted part flow directed away from the control device via a second outlet;

a grid pivotably mounted about an axis in a central part of the concentration device, the grid being positionable in a first extreme position for cleaning the heat exchanger in which the grid allows the cleaning members to pass through the principal part flow and bars the cleaning members from passing through the diverted part flow, the grid being positionable in a second extreme position in which the grid prevents the cleaning members from passing through the principal part flow and from passing through the diverted part flow;

a filter having an inlet connected to the second outlet of the concentration device; and a recycling pipe having an inlet connected to a first outlet of the filter, the recycling pipe directing the diverted part flow to the outlet pipe of the heat exchanger, wherein the filter has a tubular wall passing axially through an enclosure, that part of the tubular wall situated inside the enclosure being perforated.

8. The control system of claim 7, wherein the recycling pipe inlet is connected to the first outlet of the filter via a valve.

9. The control system of claim 7, wherein the filter comprises a second outlet discharging to atmosphere via a valve.

10. The control system of claim 9, wherein the filter is connected to the second outlet of the concentration device via a valve.

11. The control system of claim 7, wherein the recycling pipe is further connected to the inlet pipe of the heat exchanger.

12. The control system of claim 7, further comprising a second pump in the return pipe.

* * * * *